US005240798A

United States Patent [19]

Ehemann, Jr.

[11] Patent Number: 5,240,798

[45] Date of Patent: Aug. 31, 1993

[54] METHOD OF FORMING A MATRIX FOR AN ELECTROPHOTOGRAPHICALLY MANUFACTURED SCREEN ASSEMBLY FOR A CATHODE-RAY TUBE

[75] Inventor: George M. Ehemann, Jr., Lancaster, Pa.

[73] Assignee: Thomson Consumer Electronics, Indianapolis, Ind.

[21] Appl. No.: 825,888

[22] Filed: Jan. 27, 1992

[51] Int. Cl.[5] ..... G03G 5/00

[52] U.S. Cl. ..... 430/23; 430/28; 430/132; 427/68

[58] Field of Search ..... 430/23, 28, 29, 132, 430/24; 427/68

[56] References Cited

U.S. PATENT DOCUMENTS

| | | | |
|---|---|---|---|
| 4,448,866 | 5/1984 | Olieslagers et al. | 430/24 |
| 4,921,767 | 5/1990 | Datta et al. | 430/23 |
| 5,028,501 | 7/1991 | Ritt et al. | 430/23 |
| 5,093,217 | 3/1992 | Datta et al. | 430/28 |

*Primary Examiner*—Marion E. McCamish
*Assistant Examiner*—S. Rosasco
*Attorney, Agent, or Firm*—Joseph S. Tripoli; Dennis H. Irlbeck; Vincent J. Coughlin, Jr.

[57] ABSTRACT

A luminescent screen assembly for a CRT is made by first coating the interior surface of a faceplate panel with a photoconductive layer which overlies a conductive layer. A multiplicity of red-, green- and blue-emitting phosphor screen elements are then deposited in color groups, in a cyclic order, onto the interior surface of the panel. A substantially uniform charge is established on the photoconductive layer. The charge is weakened in the areas where the photoconductive layer underlies the phosphor screen elements, but unaffected in the open areas separating the phosphor screen elements. The charged open areas of the photoconductive layer are directly developed by depositing thereon particles of light-absorptive matrix material having a triboelectric charge opposite in polarity to the charge established on the photoconductive layer. The attenuation of the charge on the photoconductive layer by the overlying phosphor materials produces a sufficient voltage contrast with the charge on the open areas of the photoconductive layer to provide a high opacity matrix.

2 Claims, 3 Drawing Sheets

Fig. 1
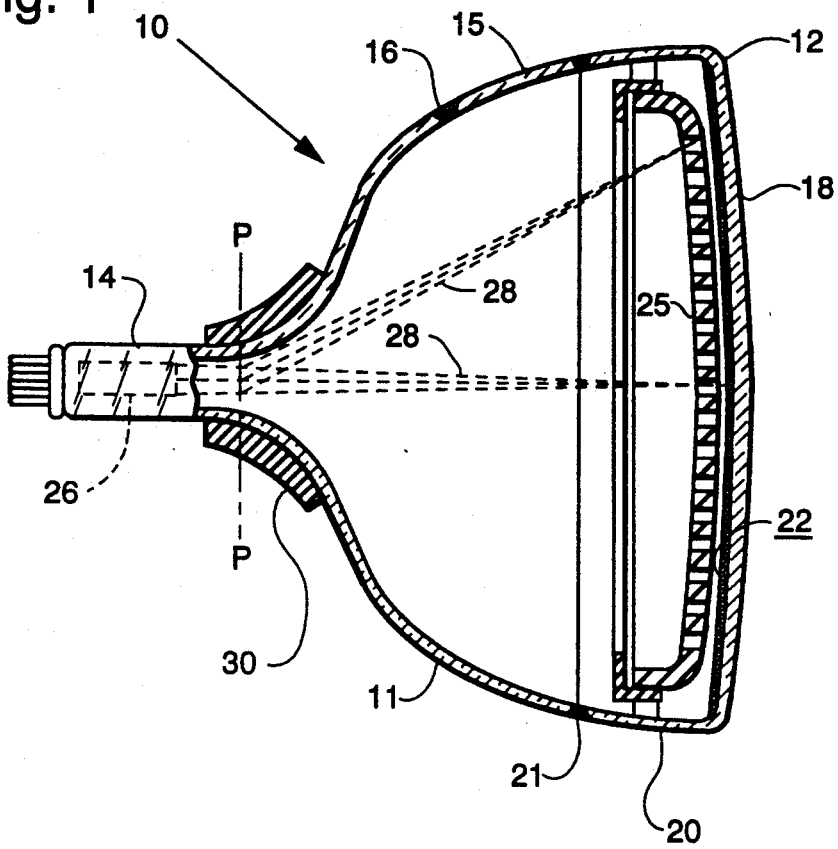
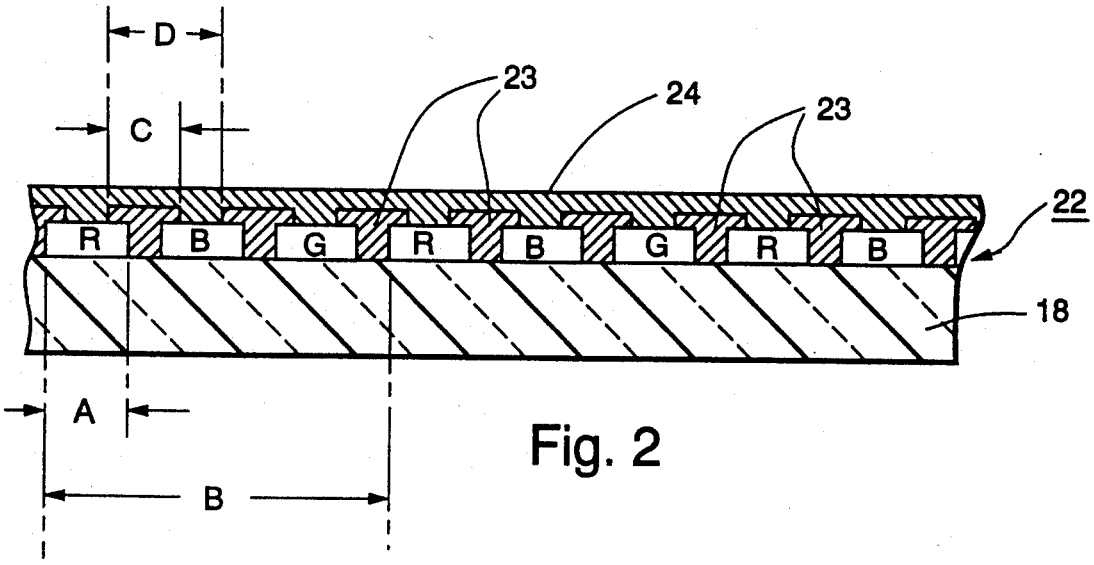
Fig. 2

METHOD OF FORMING A MATRIX FOR AN ELECTROPHOTOGRAPHICALLY MANUFACTURED SCREEN ASSEMBLY FOR A CATHODE-RAY TUBE

The present invention relates to a method of electrophotographically manufacturing a screen assembly for a cathode-ray tube (CRT), and, more particularly, to a method of electrophotographically depositing triboelectrically-charged matrix material subsequent to the deposition of phosphor materials.

BACKGROUND OF THE INVENTION

U.S. Pat. No. 4,921,767, issued to Datta et al. on May 1, 1990, describes a method of electrophotographically manufacturing a luminescent screen assembly for a CRT using triboelectrically-charged matrix and phosphor materials. In the patented method, a photoconductive layer, overlying a conductive layer, is electrostatically charged to a positive voltage and exposed, through a shadow mask, to light from a xenon flash lamp, located in a lighthouse. The exposure is repeated a total of three times, from three different lamp positions, to discharge the areas of the photoconductive layer and create an electrostatic image where the light-emitting phosphors subsequently will be deposited to form the screen. The shadow mask is removed, and triboelectrically-(negatively)charged particles of light-absorptive matrix material are deposited onto the positively-charged areas of the photoconductive layer.

After the matrix is formed, the photoconductor is recharged to a positive voltage and then exposed to light through the shadow mask to discharge the areas where the first of three triboelectrically-(positively)-charged, light-emitting phosphors will be deposited. Prior to phosphor deposition, the shadow mask, again, is removed from the faceplate panel. Then, the first triboelectrically-(positively)charged phosphor is deposited, by reversal development, onto the discharged areas of the photoconductive layer. The process is repeated twice more to deposit the second and third color-emitting phosphor materials.

One drawback of the patented method is the need to repeatedly insert and remove the shadow mask to permit the discharge of the photoconductive layer and the deposition of the phosphors. The repeated steps add time and cost to the process and increase the probability of damage, either to the screen or to the mask. Another drawback is the difficulty of obtaining sufficient opacity in the deposited matrix. The opacity is proportional to the amount of light-absorptive material that is deposited in the matrix lines. In the electrophotographic screening process, a high opacity matrix requires a high voltage contrast in the patterned electrostatic image formed on the photoconductive layer. In a 51 cm diagonal tube the matrix lines are only about 0.1 to 0.15 mm (4 to 6 mils) wide and have a pitch, or spacing, between adjacent matrix lines of only about 0.28 mm (11 mils), compared to a width of about 0.27 mm and a pitch of about 0.84 mm (33 mils) for phosphor lines of the same emissive color, thus, the reduced line size and spacing of the matrix lines increase the difficulty of forming images in the lighthouse. The combined effects of the extended width of the flash lamp and the diffraction of the light passing through the slots, or apertures, in the shadow mask, for the three exposures required for the matrix image pattern, produce overlapping penumbras on the photoconductive layer that are not totally black, but which have a light level of about 25% of that found in the highly illuminated areas of the layer. In other words, the exposure through the shadow mask does not produce a light pattern that is either totally illuminated or totally black, but instead produces a pattern of light areas separated by gray penumbras of reduced light intensity. Accordingly, the voltage contrast of the electrostatic image is much lower for the matrix exposure than for the phosphor exposures, and the resultant matrix lines are less opaque than desired, especially at the edges of the lines. It has been determined that because of the above-described light diffraction pattern through the shadow mask, it is not possible to improve the voltage contrast by increasing the exposure time, since the voltage contrast of the photoconductive layer reaches a maximum and then decreases as the light exposure time increases.

SUMMARY OF THE INVENTION

In an electrophotographic process for manufacturing a luminescent screen assembly on an interior surface of a faceplate panel of a CRT, the panel is first coated with a conductive layer and then overcoated with a photoconductive layer. A multiplicity of red-, green- and blue-emitting phosphor screen elements are deposited in color groups, in a cyclic order, onto the surface of the panel. A substantially uniform charge is established on the photoconductive layer. The charge is weakened in the areas where the photoconductive layer underlies the phosphor screen elements, but unaffected in the open areas separating the phosphor screen elements. The charged, open areas of the photoconductive layer are directly developed by depositing thereon particles of light-absorptive matrix material having a triboelectric charge opposite in polarity to the charge established on the photoconductive layer.

BRIEF DESCRIPTION OF THE DRAWINGS

FIG. 1 is a plan view, partially in axial section, of a color CRT made according to the present invention.

FIG. 2 is a section of a faceplate panel of the CRT of FIG. 1 showing a screen assembly.

DETAILED DESCRIPTION OF THE PREFERRED EMBODIMENT

Figure 3:
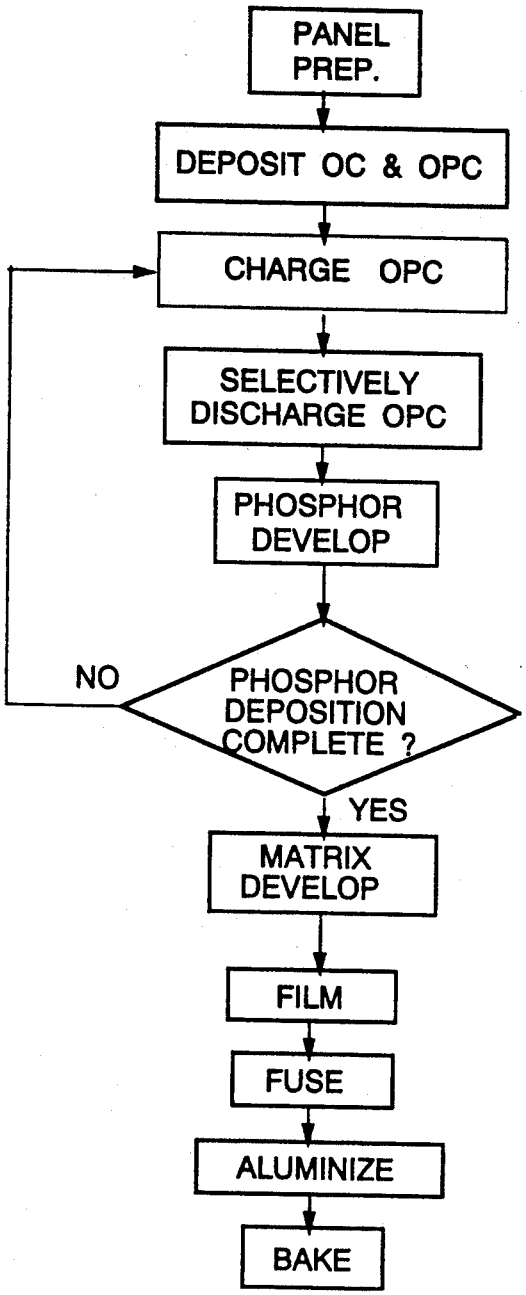
FIG. 3 is a block diagram of the novel manufacturing process for the screen assembly.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate, or substrate, 18 and a peripheral flange, or sidewall, 20 which is sealed to the funnel 15 by a glass frit 21. A three color phosphor screen 22 is carried on the inner surface of the faceplate 18. The screen 22, shown in FIG. 2, preferably is a line screen which includes a multiplicity of screen elements comprised of red-, green- and blue-emitting phosphor stripes, R, G and B, respectively, arranged in color groups, or picture elements, of three stripes, or triads, in a cyclic order, and extending in a direction which is generally normal to the plane in which the electron beams are generated. Typically, for a 51 cm diagonal tube, each of the phosphor stripes has a width, A, of about 0.27 mm and a pitch, B, of about 0.84 mm. In the normal viewing position of the embodiment, the phosphor stripes are separated from each other by a light-absorptive matrix material 23. The matrix lines typically have a width, C, of about 0.10 to 0.15 mm and a pitch, D, of about 0.28 mm. Alternatively, the screen can be a dot screen. A thin conductive layer 24, preferably of aluminum, overlies the screen 22 and provides a means for applying a uniform potential to the screen as well as for reflecting light, emitted from the phosphor elements, through the faceplate 18. The screen 22, the matrix 23 and the overlying aluminum layer 24 comprise a screen assembly.

With respect, again, to FIG. 1, a multi-apertured color selection electrode, or shadow mask, 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths, through the apertures, or slots, in the mask 25, to the screen 22.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths in the deflection zone are not shown.

The screen 22 is manufactured by an electrophotographic process that is shown in the block diagram of FIG. 3. Selected steps of the process are schematically represented in FIG. 4*a*–4*f*. The present process is similar to the process disclosed in U.S. Pat. No. 4,921,767, issued on May 1, 1990 to Datta et al, and in U.S. Pat. No. 5,028,501, issued on Jul. 2, 1991 to Ritt et al., both of which are incorporated by reference herein for the purpose of disclosure.

Figure 4A:
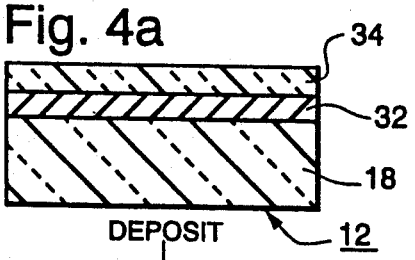
FIG. 4*a*–4*f* shows selected steps in the manufacturing of the screen assembly of FIG. 2.
Figure 4B:
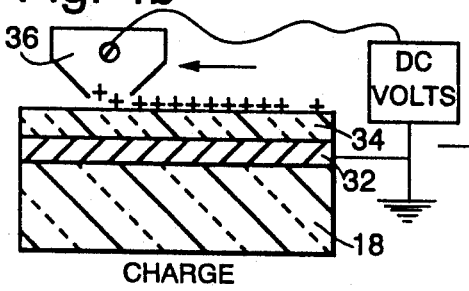
Figure 4C:
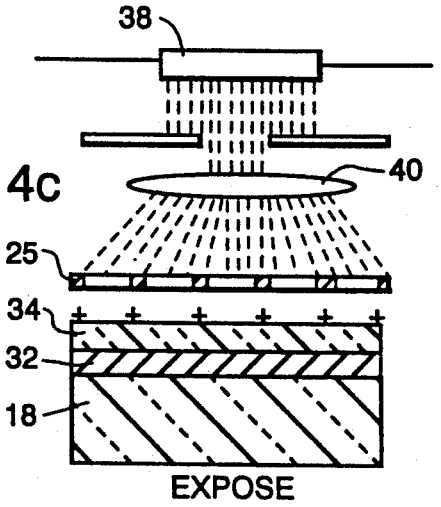
Figure 4D:
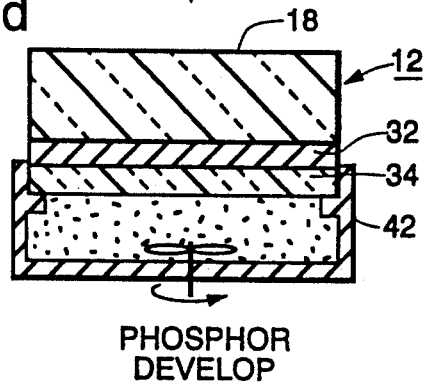

In the present process, the panel 12 initially is washed with a caustic solution, rinsed in water, etched with buffered hydrofluoric acid and rinsed again with water, as is known in the art. As shown in FIGS. 3 and 4a, the inner surface of the viewing faceplate 18 is then coated with an electrically conductive organic material which forms an organic conductive (OC) layer 32 that serves as an electrode for an overlying organic photoconductive (OPC) layer 34. Both the OC layer 32 and the OPC layer 34 are volatilizable at a temperature of about 425° C.. As shown in FIG. 4b, the OPC layer 34 is charged, in a dark environment, to a positive potential of about 200 to 600 volts by a corona discharge apparatus 36, of the type described in U.S. Pat. No. 5,083,959, issued on Jan. 28, 1992 to Datta et al., which also is incorporated by reference herein for disclosure purposes. The shadow mask 25 is inserted into the panel 12 and areas of the OPC layer 34, corresponding to the locations where green-emitting phosphor material will be deposited, are selectively discharged by exposure to actinic radiation, such as light from a xenon flash lamp 38, shown in FIG. 4*c*, disposed within a first lighthouse (represented by lens 40). The lamp location within the first lighthouse approximates the convergence angle of the green phosphor-impinging electron beam. The shadow mask 25 is removed from the panel 12, and the panel is moved to a first developer 42, shown in FIG. 4*d*, containing suitably prepared dry-powdered particles of green-emitting phosphor screen structure material. The dry-powdered phosphor particles previously have been surface treated with a suitable charge controlling material, which encapsulates the phosphor particles and permits the establishment of a triboelectrically positive charge thereon. The positively-charged, green-emitting phosphor particles are expelled from the developer, repelled by the positively-charged areas of the OPC layer 34, and deposited onto the exposed, discharged areas of the OPC layer 34, in a process known as "reversal developing". Surface treating and triboelectric charging of the phosphor particles and developing of the OPC layer 34 are described in above-cited U.S. Pat. No. 4,921,767.

The processes of charging, selectively discharging, and phosphor developing are repeated for the dry-powdered, blue- and red-emitting phosphor particles of screen structure material. The exposure to actinic radiation, to selectively discharge the positively-charged areas of the OPC layer 34, is made from locations within a second and then from a third lighthouse, to approximate the convergence angles of the blue phosphor- and red phosphor-impinging electron beams, respectively. The blue- and the red-emitting phosphor particles also are surface treated, to permit them to be triboelectrically charged to a positive potential. The blue- and red-emitting phosphor particles are expelled from second and third developers 42, repelled by the positively-charged areas of the previously deposited screen structure materials, and deposited onto the discharged areas of the OPC 34, to provide the blue- and red-emitting phosphor elements, respectively.

Figure 4E:
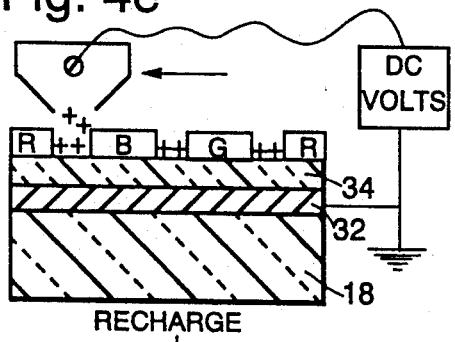
Figure 4F:
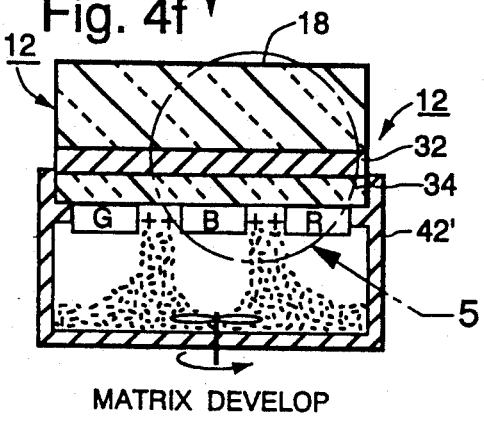
Figure 5:
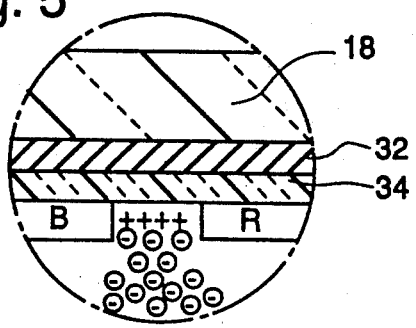
FIG. 5 is an enlargement of the portion of a charged screen shown within the circle 5 of FIG. 4*f*, during the deposition of the triboelectrically-charged matrix particles.

The matrix 23 is formed by uniformly recharging the OPC layer 34 to a positive potential of about 200 to 600 volts, as shown in FIG. 4*e*. The recharging creates electrostatic "image forces" that are weakest in the areas with overlying phosphor particles and strongest where open areas of the OPC layer 34 are exposed between adjacent phosphor areas. The attenuation of the charge on the OPC layer 34, from the overlying phosphor particles, produces a large voltage contrast with the charge on the open areas of the OPC layer. The matrix material generally contains a black pigment, which is stable at tube processing temperatures, a polymer and a suitable charge control agent. The charge control agent facilitates providing a triboelectrically charge on the matrix particles, as discussed in above-cited U.S. Pat. No. 4,921,767. Then, the panel 12 is placed on a matrix developer 42', from which finely divided particles of the negatively-charged light-absorptive matrix material are expelled. Inasmuch as the image forces vary inversely with the square of the separation distance from the positively-charged OPC layer 34, the negatively-charged matrix particles are preferentially driven, and strongly bound to the OPC layer 34, in the gaps between the phosphor elements (as shown in FIG. 5), but weakly bound to those areas already covered by the phosphor particles. Little contamination of the phosphors occurs, and the matrix is formed without the need for an additional actinic radiation-discharge step. The novel matrix deposition process, with its high voltage contrast, thus provides a matrix of greater opacity, with fewer processing steps, than the prior electrophotographic matrix process described in the above-cited U.S. Pat. Nos. 4,921,767 and 5,028,501.

The screen structure materials, comprising the surface-treated black matrix material and the green-, blue- and red-emitting phosphor particles are electrostatically attached, of bonded, to the OPC layer 34. As described in above cited U.S. Pat. 5,028,501, the adherence of the screen structure materials can be increased by directly depositing thereon an electrostatically-charged, dry-powdered, filming resin from a fifth developer (not shown). The OC layer 32 is grounded during the deposition of the filming resin. A substantially uniform potential of about 200 to 400 volts is applied to the OPC layer 34 using a discharge apparatus 36 similar to that shown in FIG. 4*e*, prior to the filming step, to provide an attractive potential and to assure a uniform deposition to the resin which, in this instance, is charged negatively. The developer may be, for example, an electrostatic gun, such as manufactured by Ransburg-GEMA, which charges the resin particles by corona discharge. The resin is an organic material with a low glass transition temperature/melt flow index of less than about 120° C., and with a pyrolization temperature of less than about 400° C. The resin is water insoluble, preferably has an irregular particle shape for better charge distribution, and has a particle size of less than about 50 microns. The preferred material is n-butyl methacrylate; however, other acrylic resins, methyl methacrylates and polyethylene waxes have been used successfully. About 2 grams of powdered filming resin is deposited onto the screen surface 22 of the faceplate 18. The faceplate is then heated to a temperature of between 100 to 120° C., for about 1 to 5 minutes using a suitable heat source, such as radiant heaters, to fuse the resin into a film (not shown). The resultant film is water insoluble and acts as a protective barrier, if a subsequent wet-filming step is required to provide additional film thickness or uniformity. Alternatively, the screen structure materials can be filmed using an aqueous emulsion, as is known in the art. An aqueous 2 to 4%, by weight, solution of boric acid or ammonium oxalate is oversprayed onto the film to form a ventilation-promoting coating (not shown). Then, the panel 12 is aluminized, as is known in the art, to form the aluminum layer 24, and baked at a temperature of about 425° C., for about 30 to 60 minutes, or until the volatilizable organic constituents of the screen assembly are removed.

What is claimed is:

1. In a method of electrophotographically manufacturing a luminescent screen assembly on an interior surface of a faceplate panel of a CRT, said panel having a conductive layer overcoated with a photoconductive layer and having a multiplicity of red-emitting, green-emitting and blue-emitting phosphor screen elements separated from each other by a light-absorptive matrix, said phosphor screen elements being arranged in color groups, in a cyclic order, said phosphor screen elements being formed by sequentially exposing selected areas of said photoconductive layer to actinic radiation, to affect the charge thereon, and then, depositing triboelectrically-charged red-, green- and blue-emitting phosphors, respectively, onto said areas, the improvement wherein said matrix is formed by establishing a substantially uniform charge on said photoconductive layer, said charge being weakened in the areas underlying said phosphor screen elements, and directly developing the charged, open areas of said photoconductive layer, separating said phosphor screen elements, by depositing onto said open areas particles of matrix material having a triboelectric charge opposite in polarity to the charge established on said photoconductive layer.

2. The method as in claim 1, further including the steps of forming a film on said phosphor screen elements and said matrix material, aluminizing said film, and baking said faceplate panel to remove the volatilizable constituents to form said luminescent screen assembly.

* * * * *

UNITED STATES PATENT AND TRADEMARK OFFICE

CERTIFICATE OF CORRECTION

PATENT NO. : 5,240,798

DATED : August 31, 1993

INVENTOR(S) : George Milton Ehemann, Jr.

It is certified that error appears in the above-identified patent and that said Letters Patent is hereby corrected as shown below:

Col. 4, line 52, after "triboelectrically" add -- -negatively--; and

Col. 5, line 8, before "bonded", change "of" to --or--.

Signed and Sealed this Eighth Day of March, 1994

Bruce Lehman

*Attest:*

BRUCE LEHMAN

*Attesting Officer*

*Commissioner of Patents and Trademarks*